United States Patent [19]

Ohnstad

[11] 4,085,819

[45] Apr. 25, 1978

[54] PLATFORM ATTACHMENT FOR A LADDER

[76] Inventor: Rudy Ohnstad, 9010 Old Highway 8, New Brighton, Minn. 55112

[21] Appl. No.: 794,543

[22] Filed: May 6, 1977

[51] Int. Cl.[2] ..... E06C 7/16

[52] U.S. Cl. ..... 182/121

[58] Field of Search ..... 182/121, 120, 122; 248/238

[56] References Cited

U.S. PATENT DOCUMENTS

| | | | |
|---|---|---|---|
| 2,432,206 | 12/1947 | Mott | 182/121 |
| 2,439,185 | 4/1948 | Patt | 182/121 |
| 2,597,756 | 5/1952 | Sitek | 248/238 |
| 3,454,132 | 7/1969 | Platino | 182/121 |
| 3,511,338 | 5/1970 | Chapman | 182/121 |
| 3,829,051 | 8/1974 | Emmons | 248/238 |

*Primary Examiner*—Reinaldo P. Machado

*Attorney, Agent, or Firm*—Williamson, Bains, Moore & Hansen

[57] ABSTRACT

A platform attachment for a ladder includes a generally rectangular, substantially flat platform having an upturned edge and having an elongate rung-engaging channel secured to the lower surface thereof. A second rung-engaging channel is secured to the platform by a pair of straps. The rung-engaging channels each have a width corresponding to the width of the platform and each is adapted to engage the full length of a ladder rung to securely mount the platform attachment on a ladder.

1 Claim, 2 Drawing Figures

PLATFORM ATTACHMENT FOR A LADDER

SUMMARY OF THE INVENTION

This invention relates to a platform attachment for ladders and more specifically to a platform attachment which may be readily and securely attached to the rungs of a ladder.

An object of this invention is to provide a novel platform attachment for ladders including a platform having a pair of elongate rung-engaging channels secured thereto and engagable with the rungs of a ladder to securely mount the platform attachment on a ladder.

Another object of this invention is to provide an improved platform attachment for ladders which is of simple and inexpensive construction.

These and other objects and advantages of this invention will more fully appear from the foregoing description made in connection with the accompanying drawings wherein like reference characters refer to the same or similar parts throughout the several views.

FIGURES OF THE DRAWINGS

DESCRIPTION OF THE PREFERRED EMBODIMENTS

Figure 1:
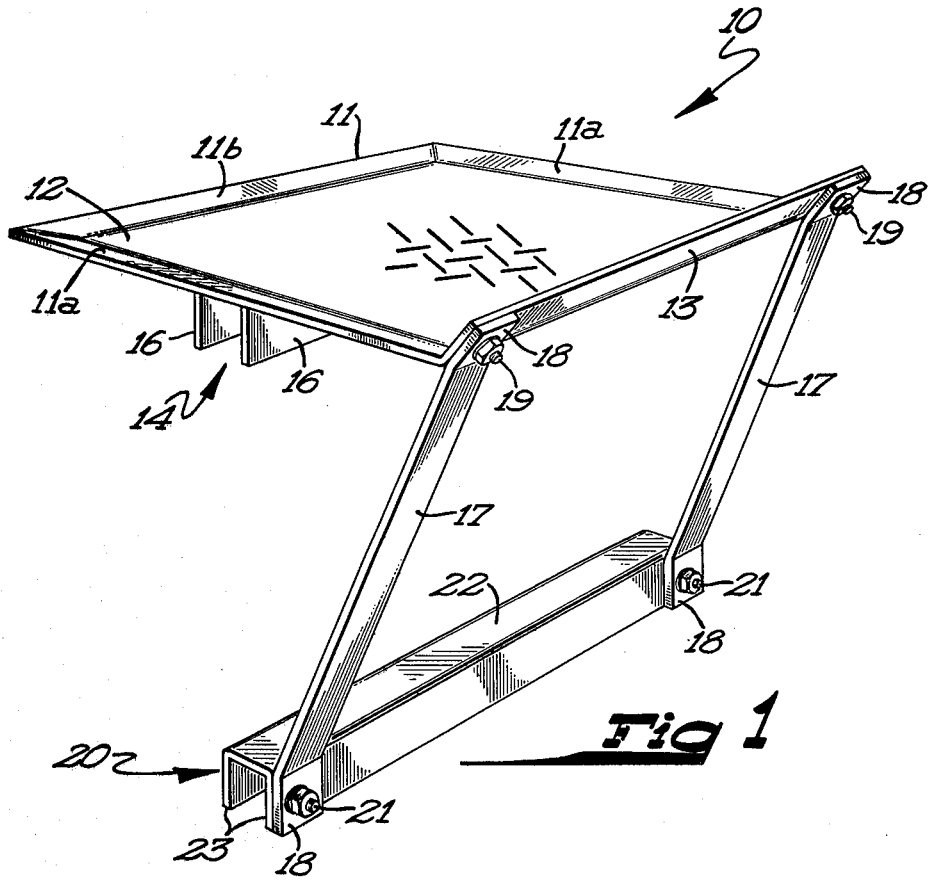
FIG. 1 is a perspective view of the novel platform attachment.
Figure 2:
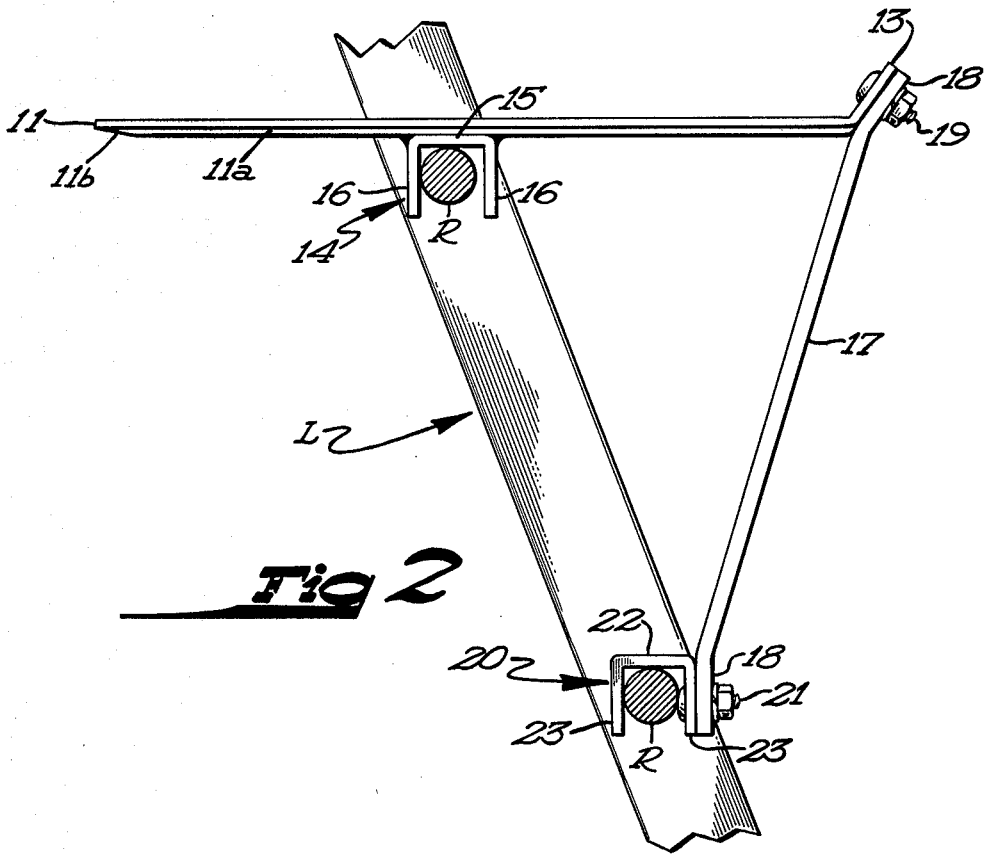
FIG. 2 is a side elevational view illustrating the manner in which the platform attachment is mounted on a ladder.

Referring now to the drawings and more specifically to FIG. 1, it will be seen that one embodiment, of the novel platform attachment, designated generally by the reference numeral 10, is thereshown. The platform attachment 10 includes a substantially flat generally rectangular shaped platform 11 formed of a suitable rigid strong material, preferably aluminum, and having a roughened upper surface 12. The platform 11 has transverse edge portions 11*a* and front longitudinal edge portions 11*b* each of which are bent upwardly at a slight angle. The rear longitudinal edge portion 13 of the platform 11 is bent upwardly at a greater angle than the remaining edge portion to define an upwardly inclined lip thereat.

An elongate rung-engaging channel 14, preferably formed of aluminum, is secured to the lower surface of the platform 11 and immediate the longitudinal edges of the latter. It will be noted that the channel 14 includes a web portion 15 welded to the lower surface of the platform 11, and a pair of legs 16 integral with the web portion and depending therefrom. It will further be noted that the length of the channel 14 corresponds substantially to the width of the platform 11 as well as to the general overall length of conventional ladder rungs.

The ladder attachment 10 also includes a pair of elongate substantially flat generally rectangular shaped braces 17, also preferably formed of aluminum or the like, and each having angularly offset end portions 18. The angularly offset end portions of each brace are each provided with an aperture, and one end of each brace 17 is secured by a suitable nut and bolt assembly 19 to the lip 13. In this respect, it will be noted that the braces 17 are secured to the outer end portions of the lip 13 so that the outermost longitudinal edge of each brace is disposed in aligned relation with respect to the longitudinal edge of the platform.

The ladder attachment 10 also includes a second rung-engaging channel 20 which is secured to the lower angularly offset end portions 18 of braces 11 by suitable nut and bolt assemblies 21. The channel 20 is also preferably formed of aluminum and is substantially identical in construction and size to channel 14. In this respect, channel 20 includes a web portion 22 having a pair of substantially parallel legs 23 angularly formed therewith and depending therefrom. It will be noted that each nut and bolt assembly 21 extend through apertures in one of the legs 23 to rigidly secure the angularly offset lower end portion of each brace to the channel 20. Again it will be noted that the outer longitudinal edge of each brace 17 is disposed in substantially aligned or coplanar relation with the associated end edge of the channel 20.

In use, the channel 14 will be positioned upon an engaging relation with a rung R of the ladder L while the channel 20 will engage the edge adjacent lower rung R. The spacing between the legs of each channel is only slightly larger than the diameter to the rung, but each channel engages a rung substantially throughout the length of the rung. The platform 11 will be disposed in substantially horizontal relation and the angularly upturned peripheral edges of the platform not only imparts strength to the platform but also reduces the likelihood of the user inadvertently falling from the platform. The upturned peripheral edge portions of the platform also minimizes the likelihood of an article, such as a paint container falling from the platform. By gripping the rungs substantially throughout their lengths, the platform will be firmly supported on the ladder. The location of the channel 14 adjacent the midportion of the platform also provides a stabilized support for the platform when the attachment is mounted on a ladder.

From the foregoing description, it will be seen that I have provided a novel and improved platform attachment for ladders, which is not only of simple and inexpensive construction, but one which is extremely sturdy and may be safely applied to ladders.

What is claimed is:

1. A platform attachment for a ladder comprising:

a substantially flat, generally rectangularly shaped platform having substantially straight longitudinal and transverse edges, the longitudinal and transverse edge portion of said platform being bent upwardly, one of said longitudinal edge portions being bent upwardly at a greater degree than the remaining longitudinal and transverse edge portions to define a lip, a first elongate channel member including a web portion secured to the lower surface of said platform, and including a pair of legs integral with and depending from said web portion, said channel member having a length corresponding to and extending substantially the width of said platform, a pair of generally vertically oriented elongate substantially flat stages each having angularly offset end portion of each strap being secured to the lip of said platform, a second elongate channel member corresponding in size to said first channel member and including a web portion and a pair of legs integral with and depending from said web portion, the other end of each of said straps being secured to one leg of said channel member whereby when said first channel member engages one rung of the ladder, the second channel member will engage the next adjacent lower rung to position platform in horizontal relation.

* * * * *

UNITED STATES PATENT AND TRADEMARK OFFICE

CERTIFICATE OF CORRECTION

PATENT NO. : 4,085,819

DATED : April 25, 1978

INVENTOR(S) : Rudy Ohnstad

It is certified that error appears in the above-identified patent and that said Letters Patent are hereby corrected as shown below:

Column 2, line 56, change "stages" to --straps--.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*